US011391195B2

(12) United States Patent
Barot

(10) Patent No.: US 11,391,195 B2
(45) Date of Patent: Jul. 19, 2022

(54) EXHAUST SYSTEM AND MUFFLER

(71) Applicant: Tenneco Automotive Operating Company Inc., Lake Forest, IL (US)

(72) Inventor: Ankit Barot, Ann Arbor, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 429 days.

(21) Appl. No.: 16/445,636

(22) Filed: Jun. 19, 2019

(65) Prior Publication Data

US 2020/0400060 A1 Dec. 24, 2020

(51) Int. Cl.

| | |
|---|---|
| ***F01N 13/08*** | (2010.01) |
| ***F01N 1/08*** | (2006.01) |
| ***F01N 13/04*** | (2010.01) |
| ***F01N 1/06*** | (2006.01) |
| ***F01N 1/02*** | (2006.01) |

(52) U.S. Cl.

CPC ..... *F01N 13/04* (2013.01); *F01N 1/023* (2013.01); *F01N 1/06* (2013.01)

(58) Field of Classification Search

CPC ..... F01N 13/04; F01N 13/08; F01N 13/1838; F01N 13/18; F01N 1/08; F01N 1/084; F01N 1/089; F01N 1/06; F01N 2470/14; F01N 2470/16; F01N 2470/24; F01N 2490/02; F01N 2490/06

See application file for complete search history.

(56) References Cited

U.S. PATENT DOCUMENTS 2,692,025 A * 10/1954 Maxim ..... F01N 1/08 181/238
3,388,769 A * 6/1968 Martoia ..... F02M 35/1227 181/238
4,064,963 A * 12/1977 Kaan ..... F01N 13/14 181/244

(Continued)

FOREIGN PATENT DOCUMENTS

DE 2706957 A1 * 8/1978 ..... F01N 1/02
DE 10254631 1/2013

(Continued)

OTHER PUBLICATIONS

PCT International Search Report and the Written Opinion of the International Searching Authority for Counterpart PCT/US2020/038117, 14 Pages, Dated Sep. 28, 2020.

*Primary Examiner* — Edgardo San Martin
(74) *Attorney, Agent, or Firm* — McGarry Bair PC

(57) ABSTRACT

A muffler for use with an engine is provided. The muffler includes a first tube defining a first inlet and a first outlet spaced apart from the first inlet. The first tube is configured to receive exhaust at the first inlet. The muffler includes a second tube spaced apart from the first tube. The second tube defines a second inlet and a second outlet spaced apart from the second inlet. The second tube is configured to receive exhaust at the second inlet. The muffler includes a third tube disposed at least partly around the second tube. The third tube defines a third outlet spaced apart from each of the second inlet and the second outlet. The third outlet is in fluid communication with the second outlet of the second tube. The muffler also includes at least one outlet tube in fluid communication with the first outlet and the third outlet.

31 Claims, 10 Drawing Sheets

(56) References Cited

U.S. PATENT DOCUMENTS

| | | | | |
|---|---|---|---|---|
| 4,164,266 | A | 8/1979 | Collin et al. | |
| 4,450,932 | A * | 5/1984 | Khosropour | F01N 5/02 181/211 |
| 5,314,009 | A * | 5/1994 | Yates | F01N 5/02 165/72 |
| 5,519,994 | A | 5/1996 | Hill | |
| 5,801,344 | A | 9/1998 | Herold | |
| 5,929,398 | A | 7/1999 | Amino et al. | |
| 6,644,437 | B1 | 11/2003 | Hayman | |
| 7,870,930 | B2 | 1/2011 | Bogard | |
| 8,028,798 | B2 * | 10/2011 | Koyanagi | F01N 1/003 181/251 |
| 8,220,587 | B2 * | 7/2012 | Mori | F01N 13/1811 181/251 |
| 8,579,077 | B2 * | 11/2013 | Ahn | F01N 1/026 181/256 |
| 9,010,486 | B2 * | 4/2015 | Andre | F01N 13/1888 181/268 |
| 9,719,384 | B2 * | 8/2017 | Nishioka | F01N 1/02 |
| 10,161,275 | B2 * | 12/2018 | Pellicone | F01N 1/083 |
| 10,787,951 | B2 * | 9/2020 | Dougherty | F01N 13/1844 |
| 2015/0354421 | A1 | 12/2015 | Horr | |
| 2019/0107019 | A1 * | 4/2019 | Ostromecki | F01N 1/023 |

FOREIGN PATENT DOCUMENTS

| | | | |
|---|---|---|---|
| GB | 2049035 | | 12/1980 |
| JP | 2007077858 | | 3/2007 |
| JP | 2008101517 | A | 5/2008 |
| JP | 2009215941 | A * | 9/2009 |
| JP | 2011085113 | A * | 4/2011 |
| KR | 20160143485 | A | 12/2016 |
| WO | 2013125764 | | 8/2013 |

* cited by examiner

SECTION A–A'

WIDE-OPEN THROTTLE CONDITION

PARTIALLY-OPEN THROTTLE CONDITION

EXHAUST SYSTEM AND MUFFLER

TECHNICAL FIELD

The present disclosure relates to an exhaust system for an engine. More particularly, the present disclosure relates to a muffler of an exhaust system for an engine.

BACKGROUND

An exhaust system for an internal combustion engine employs a muffler in order to dampen exhaust noise generated by the engine. In a multi-cylinder internal combustion engine, two different exhaust streams may be generated by two different banks of cylinders. The two exhaust streams may flow into the muffler from two different portions of an exhaust manifold through two different exhaust pipes. In many situations, a length of each of the exhaust pipes may be different from each other, such as due to different routing arrangement of each of the exhaust pipes, location of the engine, location of various vehicle components around each of the exhaust pipes, and so on. Due to difference in lengths between the exhaust pipes, a corresponding engine order noise may be generated downstream of the exhaust pipes.

SUMMARY

In an aspect of the present disclosure, a muffler for use with an engine is provided. The muffler includes a first tube defining a first inlet and a first outlet spaced apart from the first inlet. The first tube is configured to receive exhaust from the engine at the first inlet. The muffler includes a second tube spaced apart from the first tube. The second tube defines a second inlet and a second outlet spaced apart from the second inlet. The second tube is configured to receive exhaust from the engine at the second inlet. The muffler also includes a third tube disposed at least partly around the second tube. The third tube defines a third outlet spaced apart from each of the second inlet and the second outlet. The third outlet is in fluid communication with the second outlet of the second tube. The muffler further includes at least one outlet tube in fluid communication with the first outlet and the third outlet.

In another aspect of the present disclosure, an exhaust system for use with an engine having a first row of cylinders and a second row of cylinders is provided. The exhaust system includes a first pipe configured to receive exhaust from the first row of cylinders. The exhaust system also includes a second pipe configured to receive exhaust from the second row of cylinders. The exhaust system further includes a muffler. The muffler includes a first tube defining a first inlet and a first outlet spaced apart from the first inlet. The first inlet is in fluid communication with the first pipe. The muffler includes a second tube spaced apart from the first tube. The second tube defines a second inlet and a second outlet spaced apart from the second inlet. The second tube is in fluid communication with the second pipe. The muffler also includes a third tube disposed at least partly around the second tube. The third tube defines a third outlet spaced apart from each of the second inlet and the second outlet. The third outlet is in fluid communication with the second outlet of the second tube. The muffler further includes at least one outlet tube in fluid communication with the first outlet and the third outlet.

In yet another aspect of the present disclosure, a muffler for use with an engine is provided. The muffler includes a first tube defining a first inlet and a first outlet spaced apart from the first inlet. The first tube is configured to receive exhaust from the engine at the first inlet. The muffler includes a second tube spaced apart from the first tube. The second tube defines a second inlet and a second outlet spaced apart from the second inlet. The second tube is configured to receive exhaust from the engine at the second inlet. The muffler includes a third tube disposed at least partly around the second tube. The third tube defines a third outlet spaced apart from each of the second inlet and the second outlet. The third outlet is in fluid communication with the second outlet of the second tube. The muffler also includes a housing at least partly enclosing the first tube, the second tube and the third tube. The housing defines a common chamber in fluid communication with the first outlet and the third outlet. The muffler further includes at least one outlet tube in fluid communication with the common chamber.

Other features and aspects of this disclosure will be apparent from the following description and the accompanying drawings.

DETAILED DESCRIPTION

Figure 1:
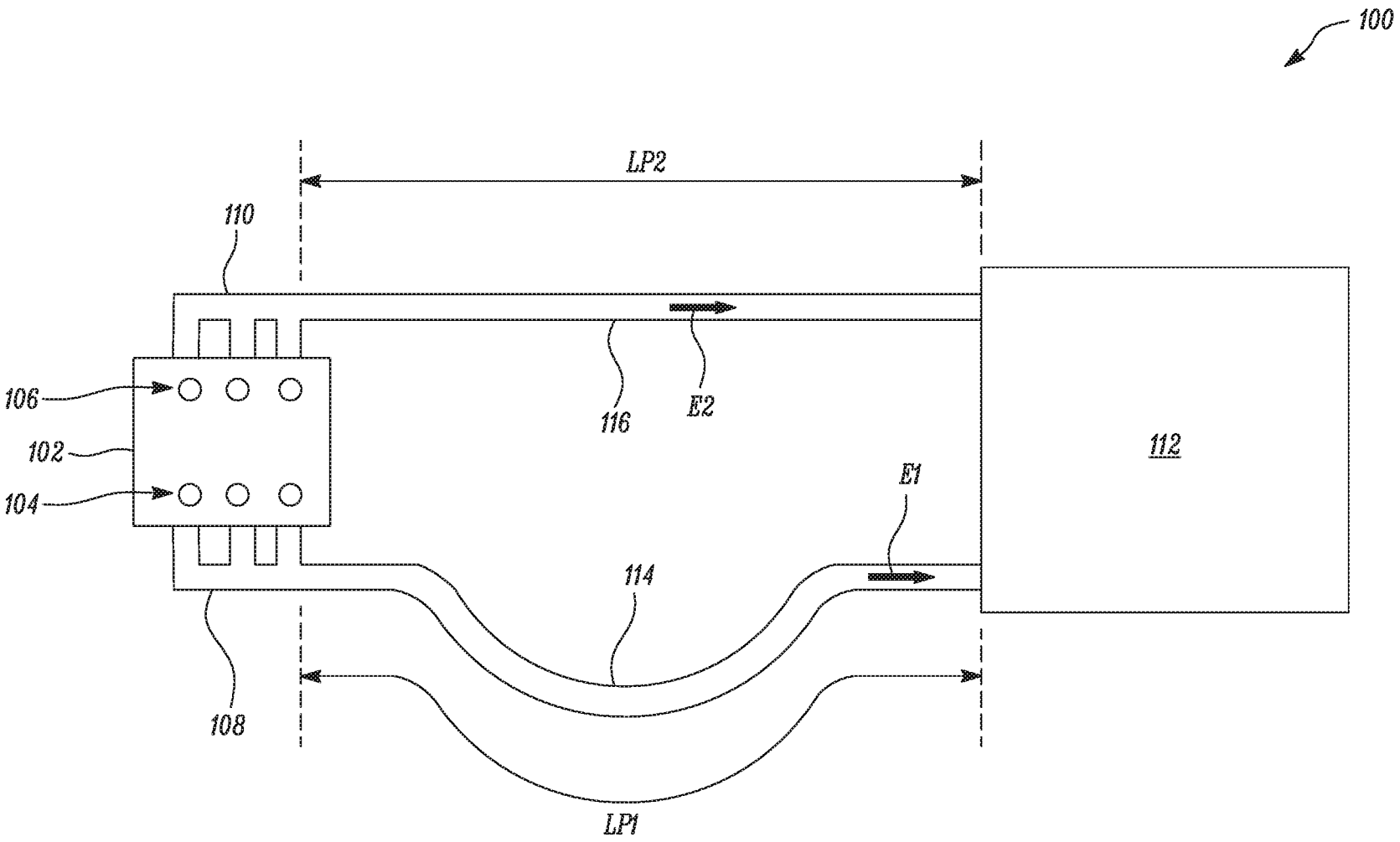
FIG. 1 is a schematic representation of an exhaust system coupled to an engine, according to an aspect of the present disclosure.

Wherever possible, the same reference numbers will be used throughout the drawings to refer to same or like parts. Referring to FIG. 1, an exemplary schematic representation of an exhaust system 100 coupled to an engine 102 is illustrated. The engine 102 may be any internal combustion engine powered by a fuel, such as gasoline, diesel, natural gas, and so on, or a combination thereof. The engine 102 is a multi-cylinder engine. Accordingly, the engine 102 includes two rows of cylinders, such as a first row of cylinders 104 and a second row of cylinders 106. The first row of cylinders 104 and the second row of cylinders 106 may correspond to two cylinder banks of the engine 102. In the illustrated embodiment, each of the first row of cylinders 104 and the second row of cylinders 106 includes three cylinders. In other embodiments, each of the first row of cylinders 104 and the second row of cylinders 106 may include any number of cylinders, based on application requirements. Also, in the illustrated embodiment, the engine 102 has a V-configuration. In other embodiments, the engine 102 may have any other configuration, such as an inline or straight configuration, and so on, based on application requirements.

The exhaust system 100 includes a first exhaust manifold 108 and a second exhaust manifold 110. The first exhaust manifold 108 is coupled to the first row of cylinders 104. Accordingly, the first exhaust manifold 108 is adapted to receive a first exhaust stream "E1" from the first row of cylinders 104. The second exhaust manifold 110 is coupled to the second row of cylinders 106. Accordingly, the second exhaust manifold 110 is adapted to receive a second exhaust stream "E2" from the second row of cylinders 106. Additionally, the engine 102 may include components and/or systems not described herein, such as an engine block, a cylinder head, a valve assembly, an intake manifold, a cooling system, a lubrication system, an air delivery system, a turbocharger, a supercharger, other peripherals, and so on, based on application requirements.

The exhaust system 100 also includes a muffler 112. The muffler 112 is coupled to each of the first exhaust manifold 108 and the second exhaust manifold 110. More specifically, the muffler 112 is coupled to the first exhaust manifold 108 via a first pipe 114. The first pipe 114 defines a first pipe length "LP1". The first pipe 114 is adapted to provide flow of the first exhaust stream "E1" from the first exhaust manifold 108 to the muffler 112. Also, the muffler 112 is coupled to the second exhaust manifold 110 via a second pipe 116. The second pipe 116 defines a second pipe length "LP2". The second pipe 116 is adapted to provide flow of the second exhaust stream "E2" from the second exhaust manifold 110 to the muffler 112.

In the illustrated embodiment, the first pipe length "LP1" of the first pipe 114 is greater than the second pipe length "LP2" of the second pipe 116. In other embodiments, the second pipe length "LP2" of the second pipe 116 may be greater than the first pipe length "LP1" of the first pipe 114. As such, a travel length of the first exhaust stream "E1" through the first pipe 114 is greater than a travel length of the second exhaust stream "E2" through the second pipe 116. Due to a difference in the travel length of each of the first exhaust stream "E1" and the second exhaust stream "E2", a half engine order noise may be created downstream of each of the first pipe 114 and the second pipe 116. Accordingly, the muffler 112 may be adapted to limit the half engine order noise downstream of each of the first pipe 114 and the second pipe 116. Additionally, the exhaust system 100 may include one or more aftertreatment components/systems (not shown), such as a Diesel Particulate Filter (DPF) unit, a Diesel Oxidation Catalyst (DOC) unit, a Diesel Exhaust Fluid (DEF) unit, a Selective Catalytic Reduction (SCR) unit, a tailpipe, and so on, based on application requirements.

Figure 2B:
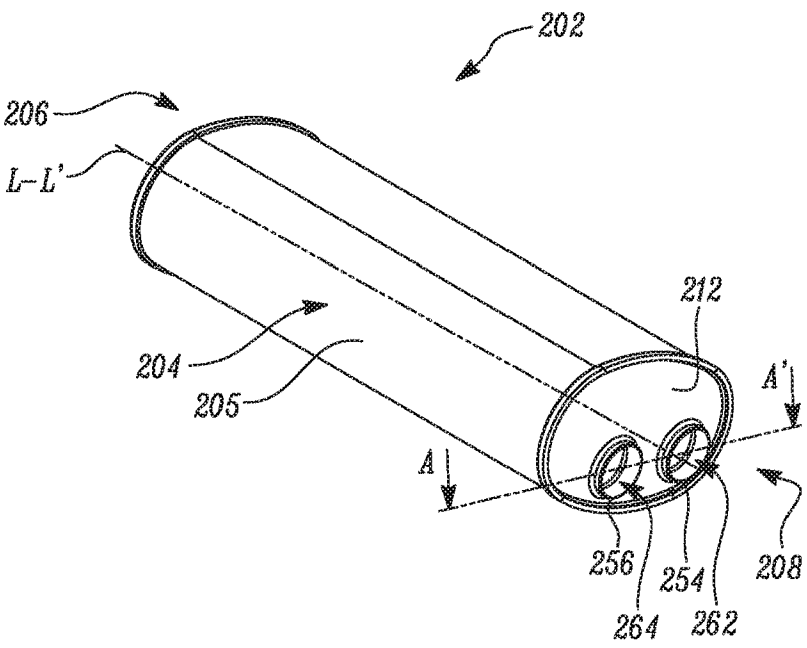
FIGS. 2A and 2B are different perspective views of a muffler, according to an aspect of the present disclosure.
Figure 2A:
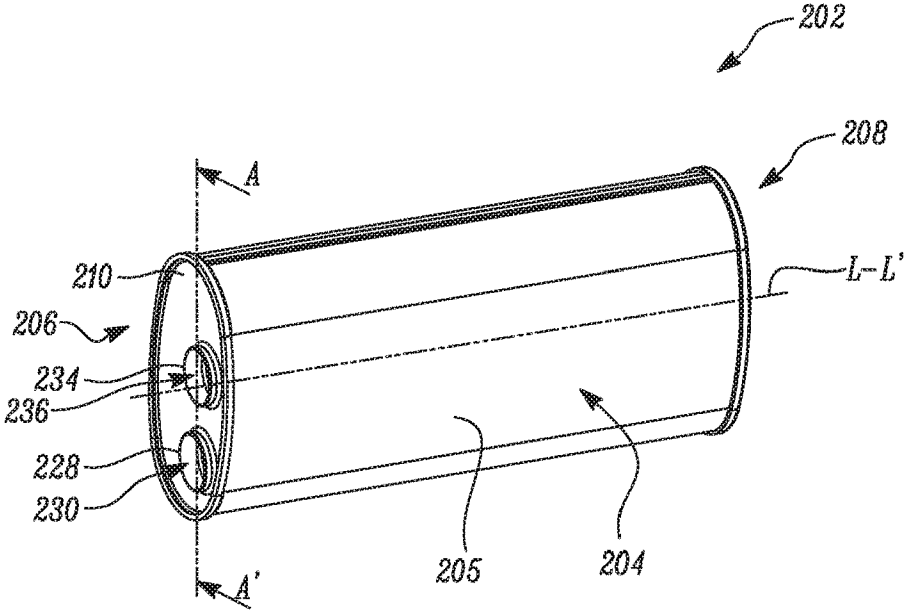
Figure 2D:
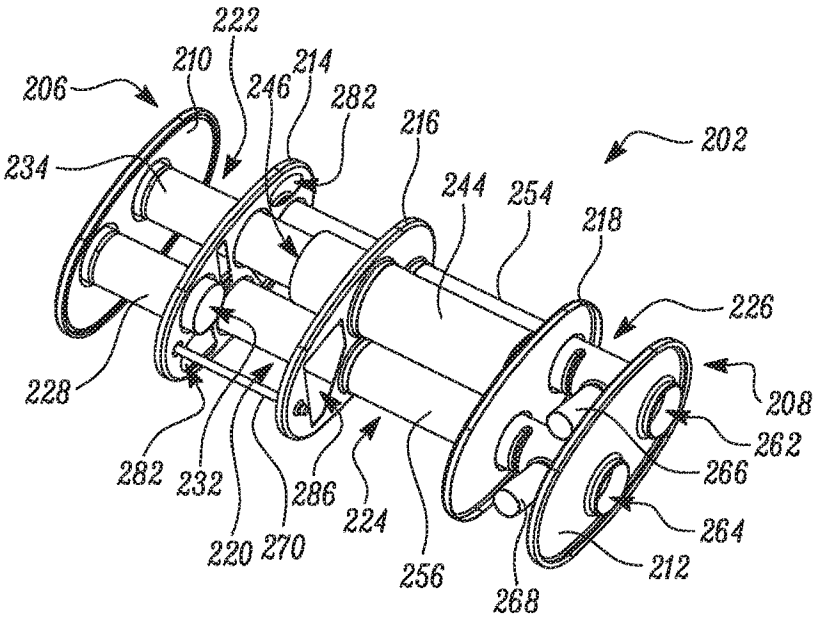
FIGS. 2C and 2D are different perspective views of the muffler of FIG. 2A without an outer shell, according to an aspect of the present disclosure.
Figure 2C:
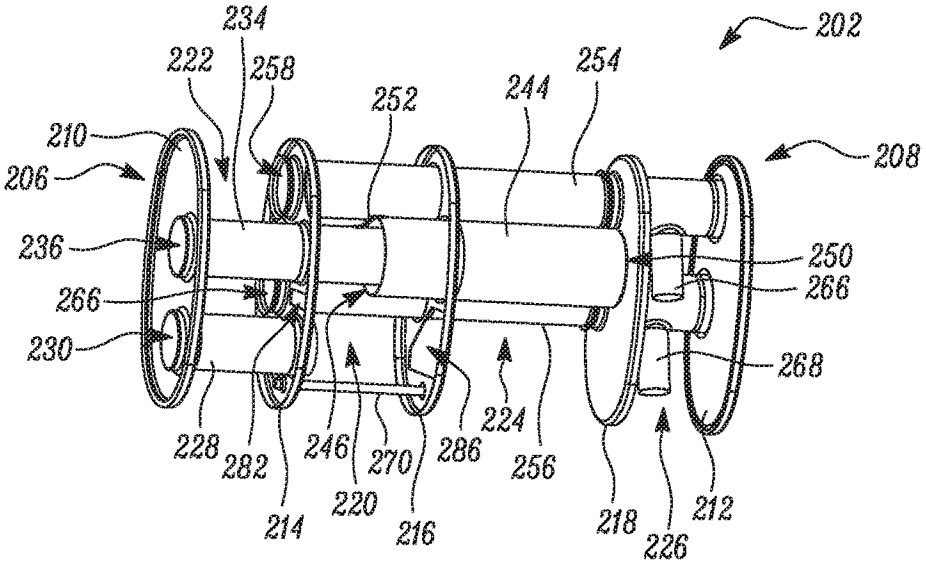
Figure 2E:
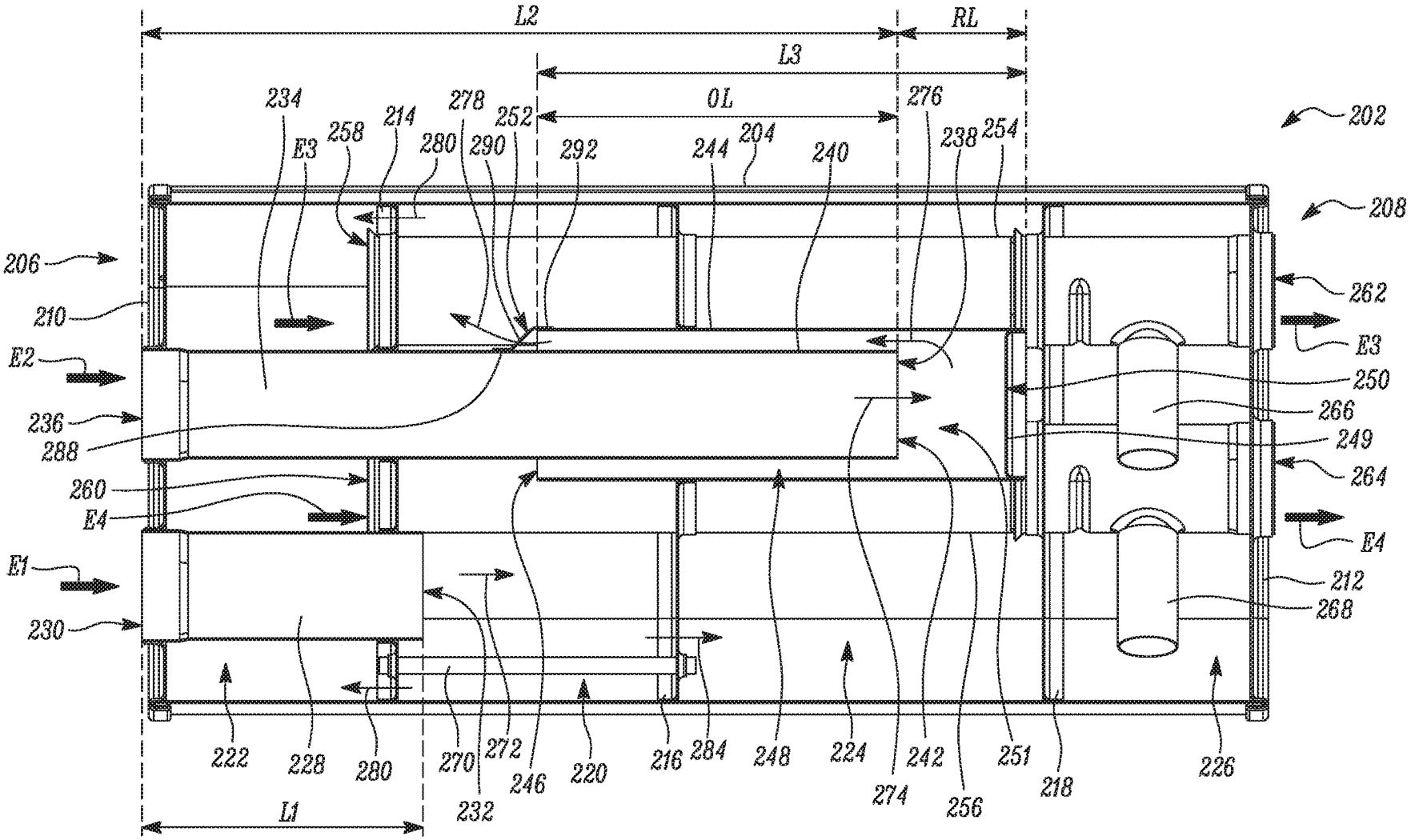
FIG. 2E is a cross-sectional view of the muffler of FIG. 2A along a section A-A', according to an aspect of the present disclosure.

Referring to FIGS. 2A, 2B, 2C, and 2D, different perspective views of one embodiment of a muffler 202 are illustrated. Referring to FIG. 2E, a cross-sectional view of the muffler 202 along a section A-A' (shown in FIGS. 2A and 2B) is illustrated. The muffler 202 will now be explained with combined reference to FIGS. 2A to 2E. The muffler 202 includes a housing 204 defining a longitudinal axis L-L' of the muffler 202. In the illustrated embodiment, the housing 204 has a substantially elliptical and elongated configuration. In other embodiments, the housing 204 may have any other configuration, such as rectangular, cylindrical, and so on, based on application requirements. The housing includes an outer shell 205. The housing 204 defines a first side 206 and a second side 208 disposed opposite to the first side 206. The housing 204 includes a first end plate 210 disposed on the first side 206 and connected to the outer shell 205. The housing 204 also includes a second end plate 212 disposed on the second side 208 and connected to the outer shell 205.

The muffler 202 includes a first internal plate 214, a second internal plate 216, and a third internal plate 218. Each of the first internal plate 214, the second internal plate 216, and the third internal plate 218 is disposed within the housing 204. Also, each of the first end plate 210, the second end plate 212, the first internal plate 214, the second internal plate 216, and the third internal plate 218 is disposed substantially parallel to and spaced apart from one another. Accordingly, the muffler 202 includes a common chamber 220 disposed between the first internal plate 214 and the second internal plate 216. The muffler 202 also includes a first chamber 222 disposed between the first end plate 210 and the first internal plate 214. The muffler 202 also includes a second chamber 224 disposed between the second internal plate 216 and the third internal plate 218. The muffler 202 further includes a third chamber 226 disposed between the second end plate 212 and the third internal plate 218.

The muffler 202 includes a first tube 228 disposed at least partly within the housing 204. The first tube 228 defines a first length "L1". The first tube 228 is at least partially disposed in the first chamber 222 extending between the first end plate 210 and the first internal plate 214. More specifically, the first tube 228 extends out from each of the first end plate 210 and the first internal plate 214. The first tube 228 defines a first inlet 230 and a first outlet 232 disposed spaced apart from the first inlet 230. In the illustrated embodiment, the first outlet 232 is disposed opposite to the first inlet 230. In other embodiments, the first outlet 232 may be disposed on a wall (not shown) of the first tube 228 and spaced apart from the first inlet 230. In such a situation, an end of the first tube 228 disposed distally opposite to the first inlet 230 may be closed. The first inlet 230 is disposed on the first end plate 210. The first inlet 230 is adapted to be fluidly coupled to the first pipe 114. Accordingly, the first inlet 230 is adapted to receive the first exhaust stream "E1" from the first pipe 114 into the first tube 228. The first outlet 232 is disposed on the first internal plate 214 and in fluid communication with the common chamber 220. Accordingly, the first outlet 232 is adapted to discharge the first exhaust stream "E1" from the first tube 228 into the common chamber 220.

The muffler 202 includes a second tube 234 disposed at least partly within the housing 204. The second tube 234 defines a second length "L2". The second length "L2" of the second tube 234 is greater than the first length "L1" of the first tube 228. The second tube 234 is disposed substantially parallel to and spaced apart from the first tube 228. The second tube 234 is disposed in each of the first chamber 222, the common chamber 220, and the second chamber 224 and extends between the first end plate 210, the first internal plate 214, and the second internal plate 216. The second tube 234 defines a second inlet 236 and a second outlet 238. The second inlet 236 is disposed spaced apart from the second outlet 238 along the longitudinal axis L-L'. The second inlet 236 is disposed on the first end plate 210. The second inlet 236 is adapted to be fluidly coupled to the second pipe 116. Accordingly, the second inlet 236 is adapted to receive the second exhaust stream "E2" from the second pipe 116 into the second tube 234. In the illustrated embodiment, the second outlet 238 is disposed opposite to the second inlet 236 and within the second chamber 224. In other embodiments, the second outlet 238 may be disposed on a wall 240 of the second tube 234 spaced apart from the second inlet 236 and within the second chamber 224. In such a situation, a distal end 242 of the second tube 234 may be closed.

The muffler 202 also includes a third tube 244 disposed within the housing 204. The third tube 244 defines a third length "L3". The third length "L3" of the third tube 244 is greater than the first length "L1" of the first tube 228. Accordingly, a sum of the second length "L2" of the second tube 234 and the third length "L3" of the third tube 244 is greater than the first length "L1" of the first tube 228. In other embodiments, each of the second length "L2" of the second tube 234 and the third length "L3" of the third tube 244 may be smaller than the first length "L1" of the first tube 228. However, the sum of the second length "L2" of the second tube 234 and the third length "L3" of the third tube 244 may be greater than the first length "L1" of the first tube 228. The third tube 244 is disposed substantially parallel to and spaced apart from each of the first tube 228 and the second tube 234. Also, the third tube 244 is disposed at least partly around the second tube 234.

More specifically, the third tube 244 is disposed concentrically around the second tube 234, such that a portion of the third tube 244 overlaps the second tube 234 defining an overlap length "OL" and a reversal length "RL". As such, the third length "L3" of the third tube 244 is equal to a sum of the overlap length "OL" and the reversal length "RL". Alternatively, the third tube 244 may be eccentrically disposed around the second tube 234. The third tube 244 is disposed in each of the common chamber 220 and the second chamber 224. The third tube 244 defines a third outlet 246. The third outlet 246 is spaced apart from each of the second inlet 236 and the second outlet 238 of the second tube 234. Additionally, the third outlet 246 is disposed axially between the second inlet 236 and the second outlet 238 of the second tube 234 relative to the longitudinal axis L-L'. Also, the third outlet 246 is provided in fluid communication with the second outlet 238 of the second tube 234 through a gap 248 provided between the second tube 234 and the third tube 244. The gap 248 may be an annular gap between the second tube 234 and the third tube 244.

The third tube 244 also includes a closed end 250 defined by an end wall 249 disposed opposite to the third outlet 246 relative to the longitudinal axis L-L'. More specifically, the closed end 250 is axially spaced apart from the second outlet 238 of the second tube 234 relative to the longitudinal axis L-L'. Accordingly, the second outlet 238 of the second tube 234 is axially disposed between the closed end 250 and the third outlet 246 of the third tube 244. The second outlet 238 of the second tube 234 is adapted to discharge the second exhaust stream "E2" within the third tube 244 into a reversal portion 251. The reversal portion 251 defines the reversal length "RL". The third tube 244 is adapted to receive the second exhaust stream "E2" from the second outlet 238 of the second tube 234 into the reversal portion 251 and to allow flow of the second exhaust stream "E2" through the gap 248. The third outlet 246 is provided in fluid communication with the common chamber 220. Accordingly, the third outlet 246 is adapted to discharge the second exhaust stream "E2" into the common chamber 220.

The muffler 202 also includes a connecting member 252 disposed between the second tube 234 and the third tube 244. More specifically, the connecting member 252 is disposed adjacent to the third outlet 246. The connecting member 252 is adapted to connect the second tube 234 to the third tube 244 and provide structural rigidity between the second tube 234 and the third tube 244. The connecting member 252 includes a first part 288 connected to an outer surface of the second tube 234, a second part 290 extending from the first part 288, and a third part 292 connected to an outer surface of the third tube 244. The second part 290 is inclined to each of the first part 288 and the third part 292. The first part 288 and the third part 292 are substantially parallel to each other. The first part 288 may be connected to the second tube 234 by various methods, such as welding, adhesives, mechanical joints, fasteners, and so forth. Similarly, the third part 292 may be connected to the third tube 244 by various methods, such as welding, adhesives, mechanical joints, fasteners, and so forth.

In the illustrated embodiment, the muffler 202 includes a single connecting member 252. In other embodiments, the muffler 202 may include multiple connecting members, such that each of the multiple connecting members may be disposed at any location between the second tube 234 and the third tube 244. In yet other embodiments, the second tube 234 may be connected to the third tube 244 using any other coupling method, such as a pin-type weld, a pipe-to-pipe joint, and so on. Alternatively, in some embodiments, each of the second tube 234 and the third tube 244 may be connected to any of the first end plate 210, the first internal plate 214, the second internal plate 216, and/or the third internal plate 218, based on application requirements, such that the second tube 234 and the third tube 244 may have a pipe-on-pipe configuration.

The muffler 202 further includes a number of outlet tubes, such as a first outlet tube 254 and a second outlet tube 256, disposed at least partly within the housing 204. Each of the first outlet tube 254 and the second outlet tube 256 is disposed substantially parallel to and spaced apart from one another and each of the first tube 228, the second tube 234, and the third tube 244. Each of the first outlet tube 254 and the second outlet tube 256 is disposed in each of the first chamber 222, the common chamber 220, the second chamber 224, and the third chamber 226 and extends between the first internal plate 214, the second internal plate 216, the third internal plate 218, and the second end plate 212. Each of the first outlet tube 254 and the second outlet tube 256 is provided in fluid communication with the first outlet 232 of the first tube 228 and the third outlet 246 of the third tube 244 via the common chamber 220. The first outlet tube 254 includes an inlet end 258 and an outlet end 262. Similarly, the second outlet tube 256 includes an inlet end 260 and an outlet end 264. Each of the outlet ends 262, 264 is disposed opposite to the respective inlet ends 258, 260 relative to the longitudinal axis L-L'.

Each of the inlet ends 258, 260 is disposed on the first internal plate 214 and in fluid communication with the common chamber 220. Accordingly, the first outlet tube 254 and the second outlet tube 256 are adapted to receive a third exhaust stream "E3" and a fourth exhaust stream "E4" from the common chamber 220 via the inlet ends 258, 260, respectively. Each of the outlet ends 262, 264 is disposed on the second end plate 212. Further, each of the outlet ends 262, 264 may be fluidly coupled to a downstream component (not shown) of the exhaust system 100, such as the tailpipe. Accordingly, the outlet ends 262, 264 are adapted to discharge the third exhaust stream "E3" and the fourth exhaust stream "E4" from the first outlet tube 254 and the second outlet tube 256, respectively, out of the muffler 202.

The muffler 202 also includes a first branch tube 266 and a second branch tube 268. The first branch tube 266 and the second branch tube 268 are coupled to the first outlet tube 254 and the second outlet tube 256, respectively. Also, each of the first branch tube 266 and the second branch tube 268 is disposed within the housing 204 and within the third chamber 226. The first branch tube 266 and the second branch tube 268 are adapted to discharge a portion of the third exhaust stream "E3" and a portion of the fourth exhaust stream "E4" from the first outlet tube 254 and the second outlet tube 256, respectively, into the third chamber 226. As such, each of the first branch tube 266 and the second branch tube 268 is adapted to improve tuning of the muffler 202 and/or limit a pressure differential between the third chamber 226 and each of the first outlet tube 254 and the second outlet tube 256, respectively. The first and second branch tubes 266, 268 may therefore act as side branch tuners for the muffler 202.

Additionally, the muffler 202 includes a reinforcing rod 270 extending between each of the first internal plate 214 and the second internal plate 216. The reinforcing rod 270 is disposed substantially parallel to and spaced apart from each of the first tube 228, the second tube 234, the third tube 244, the first outlet tube 254, and the second outlet tube 256. The reinforcing rod 270 is adapted to provide structural rigidity to each of the first internal plate 214 and the second internal plate 216. In other embodiments, the reinforcing rod 270 may be, additionally or optionally, provided between the first end plate 210 and the first internal plate 214, the second internal plate 216 and the third internal plate 218, and/or the third internal plate 218 and the second end plate 212.

During operation, the first exhaust stream "E1" is received into the muffler 202 from the first pipe 114 (shown in FIG. 1) via the first inlet 230 of the first tube 228 and is discharged into the common chamber 220 via the first outlet 232 of the first tube 228, as shown by an arrow 272. The second exhaust stream "E2" is received into the muffler 202 from the second pipe 116 (shown in FIG. 1) via the second inlet 236 of the second tube 234 and is discharged into the third tube 244 via the second outlet 238 of the second tube 234, as shown by an arrow 274. Due to the closed end 250 of the third tube 244, the second exhaust stream "E2" deflects in the reversal portion 251 and flows into the gap 248, as shown by an arrow 276, and is further discharged into the common chamber 220 via the third outlet 246 of the third tube 244, as shown by an arrow 278.

As the second exhaust stream "E2" flows through the muffler 202, the second exhaust stream "E2" travels a distance approximately equal to the difference between the first pipe length "LP1" of the first pipe 114 and the second pipe length "LP2" of the second pipe 116. More specifically, the difference between the first pipe length "LP1" of the first pipe 114 and the second pipe length "LP2" of the second pipe 116 may be approximately equal to a sum of the second length "L2" of the second tube 234 and the third length "L3" of the third tube 244 less the first length "L1" of the first tube 228, i.e., (LP1−LP2) may be approximately equal to [(L2+L3)−L1]. As such, each of the second length "L2" of the second tube 234 and the third length "L3" of the third tube 244 compensates for the difference between the first pipe length "LP1" of the first pipe 114 and the second pipe length "LP2" of the second pipe 116, in turn, decreasing the half engine order noise downstream of the muffler 202.

In other words, the sum of the second length "L2" of the second tube 234 and the third length "L3" of the third tube 244 is greater than the first length "L1" of the first tube 228, i.e., (L2+L3) is greater than (L1). Accordingly, the half engine order noise generated due to the difference between the first pipe length "LP1" of the first pipe 114 and the second pipe length "LP2" of the second pipe 116 is decreased. Therefore, (L2+L3) is greater than (L1) such that the half engine order noise downstream of the muffler 202 is decreased. In such a situation, a sum of the first pipe length "LP1" of the first pipe 114 and the first length "L1" of the first tube 228 is approximately equal to a sum of the second pipe length "LP2" of the second pipe 116, the second length "L2" of the second tube 234 and the third length "L3" of the third tube 244, i.e., (LP1+L1) is approximately equal to (LP2+L2+L3) in order to decrease the half engine order noise downstream of the muffler 202. The second and third tubes 234, 244 may therefore allow flow reversal of the second exhaust stream "E2", thereby increasing a flow length of the second exhaust stream "E2" with respect to the first exhaust stream "E1". Accordingly, the travel length of the second exhaust stream "E2" through the second pipe 116, the second tube 234 and the third tube 244 is approximately equal to the travel length of the first exhaust stream "E1" through the first pipe 114 and the first tube 228. Further, the overlap between the second and third tubes 234, 244 may provide a compact configuration without reducing the flow length through the second and third tubes 234, 244.

The first exhaust stream "E1" and the second exhaust stream "E2" mix with each other within the common chamber 220 forming a mixed exhaust stream. The mixed exhaust stream flows into the first chamber 222 from the common chamber 220, as shown by arrows 280, via one or more apertures 282 provided on the first internal plate 214. In the illustrated embodiment, the first internal plate 214 includes a number of such apertures 282 with different shapes, such as rectangular, circular, oval and so forth. A number and shapes of the apertures 282 may be varied as per application requirements. In some situations, a portion of the mixed exhaust stream may also flow into the second chamber 224 from the common chamber 220, as shown by an arrow 284, via one or more apertures 286 provided on the second internal plate 216. The portion of the mixed exhaust stream may flow into the second chamber 224 from the common chamber 220 based on a pressure differential between the common chamber 220 and the second chamber 224. In the illustrated embodiment, the second internal plate 216 includes one such aperture 286 with a polygonal shape. A number and shapes of the apertures 286 may be varied as per application requirements.

Further, the mixed exhaust stream present in the common chamber 220 divides into the third exhaust stream "E3" and the fourth exhaust stream "E4" such that the third exhaust stream "E3" flows into the first outlet tube 254 via the inlet end 258, and the fourth exhaust stream "E4" flows into the second outlet tube 256 via the inlet end 260. The third exhaust stream "E3" flows through the first outlet tube 254 and is discharged out of the muffler 202 via the outlet end 262. A portion of the third exhaust stream "E3" may be discharged into the third chamber 226 via the first branch tube 266 based on the pressure differential between the first outlet tube 254 and the third chamber 226, in turn, improving tuning of the muffler 202. Also, the fourth exhaust stream "E4" flows through the second outlet tube 256 and is discharged out of the muffler 202 via the outlet end 264. A portion of the fourth exhaust stream "E4" may be discharged into the third chamber 226 via the second branch tube 268 based on the pressure differential between the second outlet tube 256 and the third chamber 226, in turn, improving tuning of the muffler 202.

The configuration of the muffler 202, as shown in FIGS. 2A to 2E, are exemplary in nature and alternative configurations are possible within the scope of the present disclosure. For example, though the first, second and third tubes 228, 234, 244 are illustrated as substantially straight hollow cylindrical tubes, the first, second and/or third tubes 228, 234, 244 may have alternative shapes, such as curvilinear with non-circular cross-sections.

Figure 6:
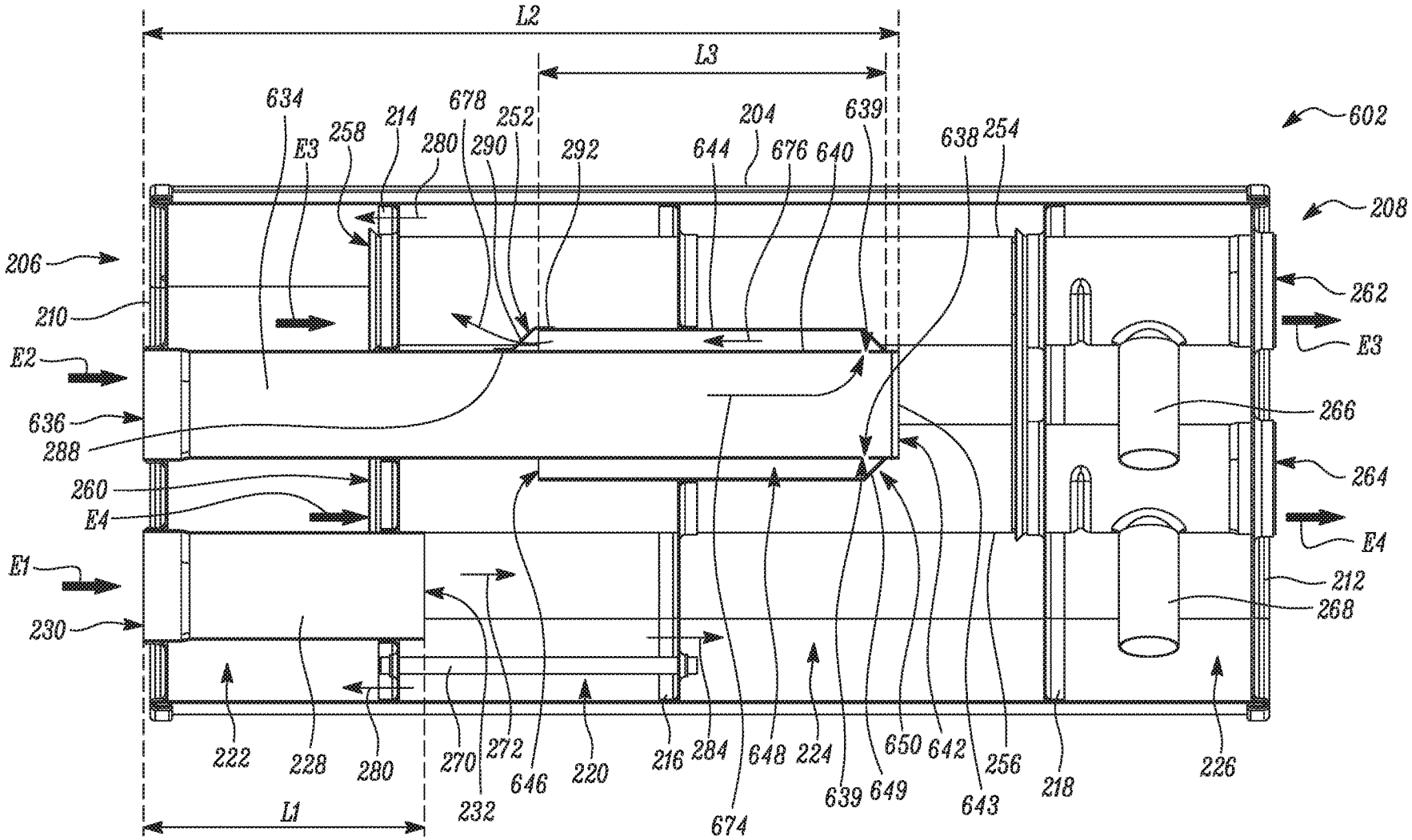
FIG. 6 is a cross-sectional view of another muffler, according to another aspect of the present disclosure.

Referring to FIG. 6, a cross sectional view of another embodiment of a muffler 602 is illustrated. The muffler 602 has a configuration substantially similar to the configuration of the muffler 202. As such, the muffler 602 includes the housing 204 having the first side 206, the second side 208, the first end plate 210, the second end plate 212, the first internal plate 214, the second internal plate 216, the third internal plate 218, the common chamber 220, the first chamber 222, the second chamber 224, and the third chamber 226. The muffler 602 also includes the first tube 228 having the first inlet 230 and the first outlet 232. The muffler 602 also includes the connecting member 252 having the first part 288, the second part 290, and the third part 292. The muffler 602 also includes the first outlet tube 254 having the inlet end 258 and the outlet end 262, the second outlet tube 256 having the inlet end 260 and the outlet end 264, the first branch tube 266, the second branch tube 268, and the reinforcing rod 270. The muffler 602 also includes the aperture 282 and the aperture 286.

In the illustrated embodiment, the muffler 602 includes a second tube 634 having a second inlet 636, a second outlet 638, a wall 640, and a closed end 642 defined by an end wall 643. The wall 640 extends between the second inlet 636 and the end wall 643. The end wall 643 and the closed end 642 are disposed axially opposite to the second inlet 636. The second outlet 638 is defined by one or more openings 639 disposed on the wall 640. The one or more openings 639 are through holes disposed on the wall 640. In case of multiple openings 639, the openings 639 may be angularly and/or axially separated from each other. A number, a shape and dimensions of each opening 639 may be varied as per application requirements. The second outlet 638 is disposed adjacent to the end wall 643 and the closed end 642. Also, the second outlet 638 is disposed spaced apart from the second inlet 636 and within the second chamber 224.

The muffler 602 also includes a third tube 644 having a third outlet 646. The third tube 644 is disposed concentrically around the second tube 634 forming a gap 648 therebetween. The third outlet 646 is provided in fluid communication with the second outlet 638 of the second tube 634 through the gap 648 provided between the second tube 634 and the third tube 644. The third tube 644 also includes a closed end 650 defined by an end wall 649 disposed axially opposite to the third outlet 646. The third tube 644 is connected to the second tube 634 adjacent to the closed end 642 of the second tube 634. More specifically, the end wall 649 of the third tube 644 is connected to the wall 640 of the second tube 634 adjacent to the closed end 642 of the second tube 634. The third outlet 646 is spaced apart from each of the second inlet 636 and the second outlet 638 of the second tube 634. Accordingly, the second outlet 638 of the second tube 634 is axially disposed between the closed end 642 of the second tube 634 and the third outlet 646 of the third tube 644.

Specifically, the one or more openings 639 are axially disposed between the closed end 642 of the second tube 634 or the closed end 650 of the third tube 644, and the third outlet 646 of the third tube 644. In other words, the one or more openings 639 are disposed between the closed end 642 of the second tube 634 or the closed end 650 of the third tube 644, and the third outlet 646 of the third tube 644 relative to a longitudinal axis (not shown) of the muffler 602. In such a situation, the reversal portion 251 of the muffler 202 is omitted. The end wall 649 of the third tube 644 may be connected to the wall 640 of the second tube 634 by various methods, such as welding, adhesives, mechanical joints, fasteners, a pin-type weld, a pipe-to-pipe joint, and so on, based on application requirements. In some embodiments, the third tube 644 may be pinched down to form the end wall 649 which is connected to the second tube 634.

During operation, the second exhaust stream "E2" is received into the muffler 602 from the second pipe 116 (shown in FIG. 1) via the second inlet 636 of the second tube 634. The second exhaust stream "E2" is then deflected by the end wall 643 and the closed end 642 of the second tube 634 and is discharged into the third tube 644 via the second outlet 638 of the second tube 634, as shown by an arrow 674. Specifically, the second exhaust stream "E2" flows through the one or more openings 639. Due to the end wall 649 and the closed end 650 of the third tube 644, the second exhaust stream "E2" flows through the gap 248, as shown by an arrow 676. As such, the second exhaust stream "E2" undergoes flow reversal upon entering the gap 248. The second exhaust stream "E2" is further discharged into the common chamber 220 via the third outlet 646 of the third tube 644, as shown by an arrow 678.

Figure 3B:
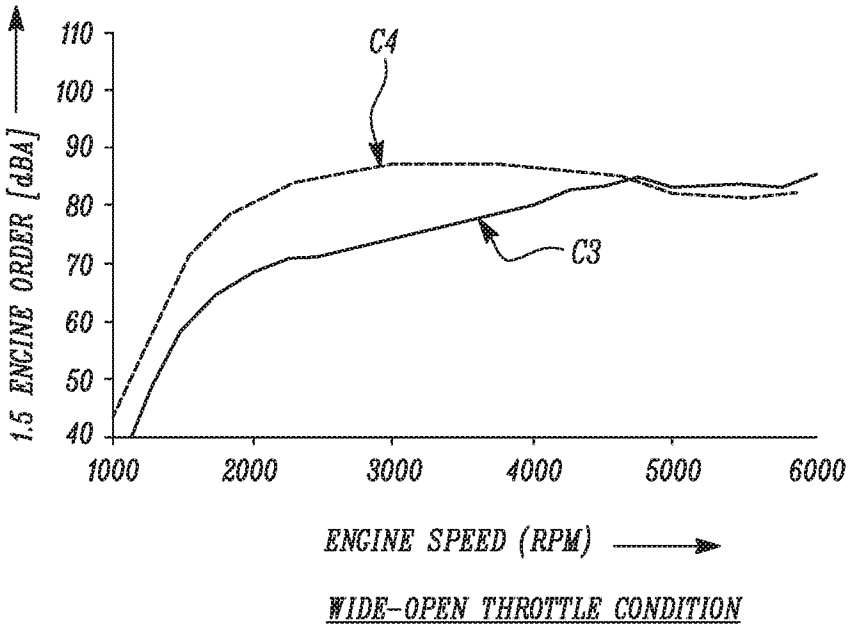
FIGS. 3A and 3B are exemplary graphical representations of a performance of the muffler of FIG. 2A with respect to a conventional muffler.
Figure 3A:
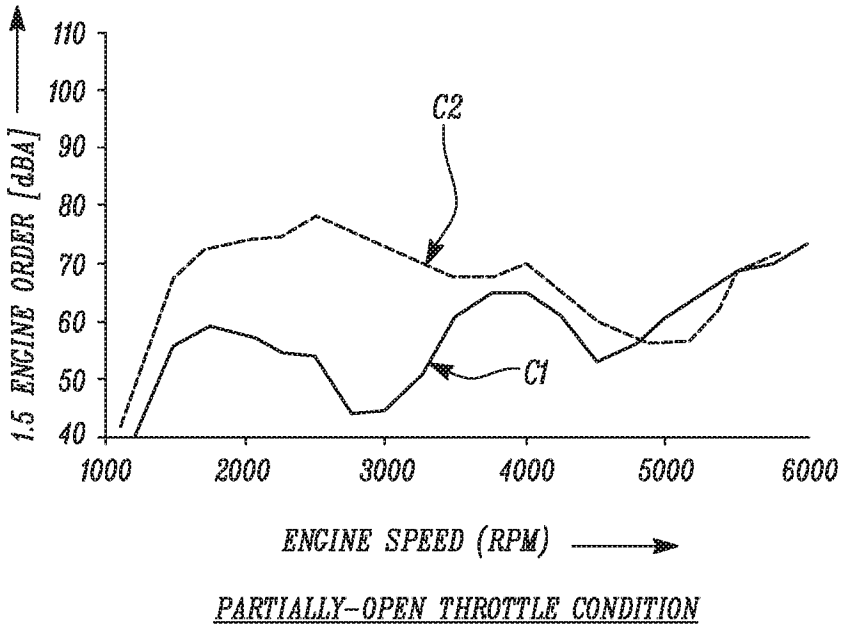
Figure 4B:
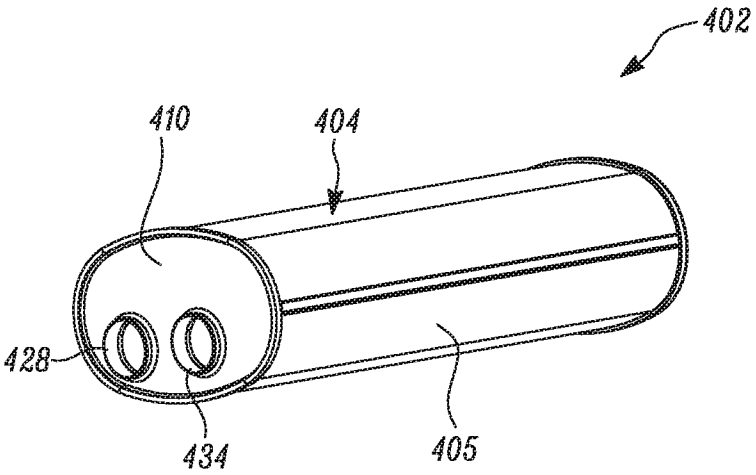
FIGS. 4A and 4B are different perspective views of another muffler, according to another aspect of the present disclosure.
Figure 4A:
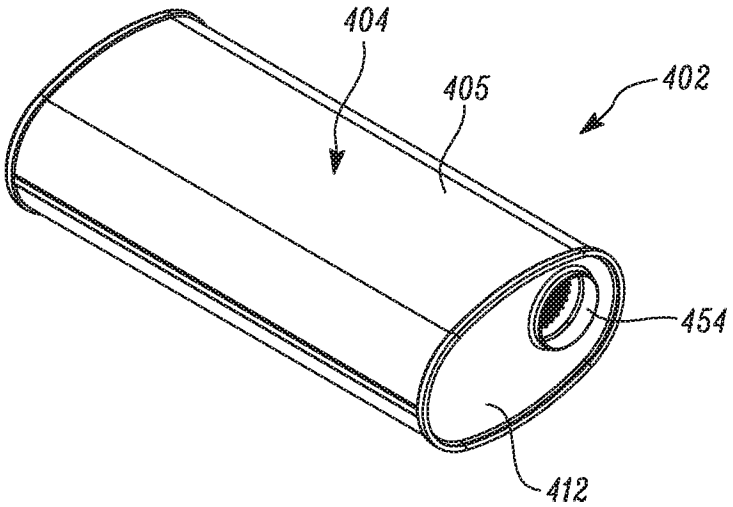
Figure 4D:
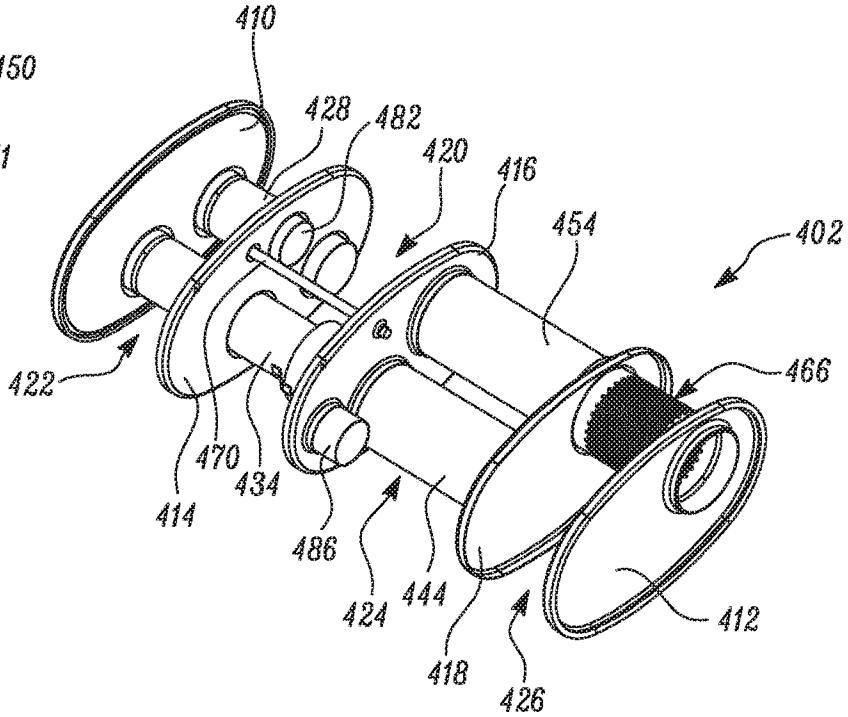
FIGS. 4C and 4D are different perspective views of the muffler of FIG. 4A without an outer shell, according to an aspect of the present disclosure.
Figure 4C:
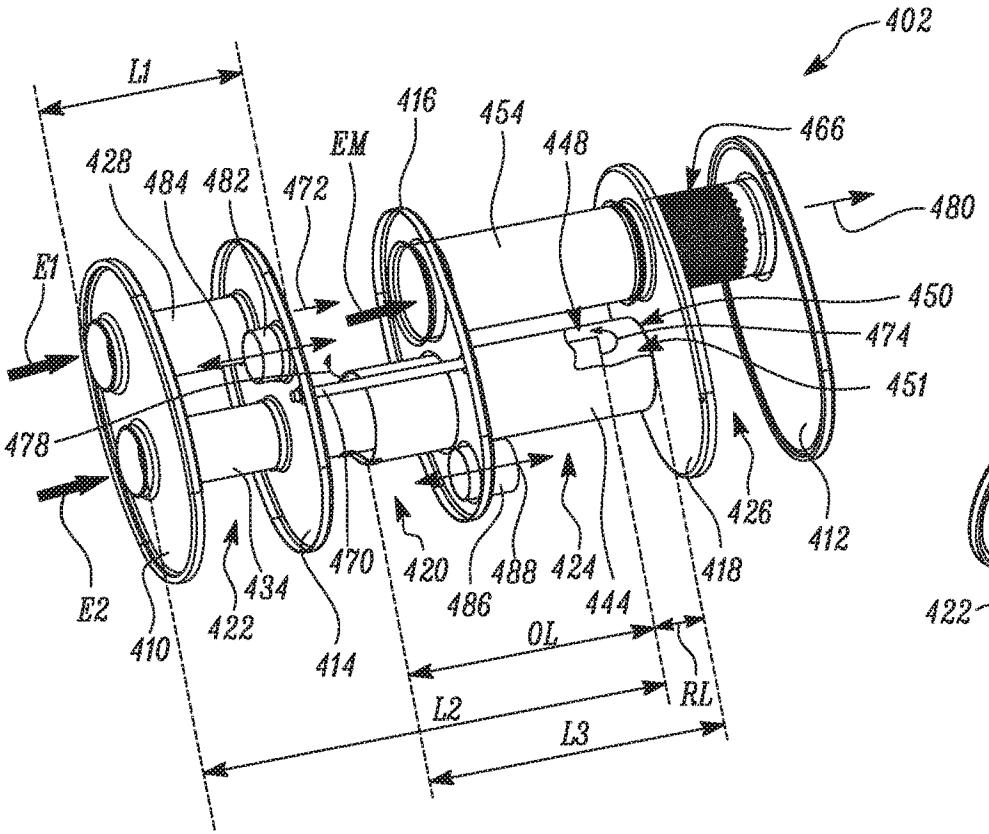

Referring to FIGS. 3A and 3B, exemplary graphical representations of a performance of the muffler 202 in comparison to performance of a conventional muffler (not shown) are illustrated. The conventional muffler refers to a muffler without an arrangement of the second tube 234 and the third tube 244 as described with reference to the muffler 202.

Referring to FIG. 3A, a graphical representation of engine speed against one and a half (1.5) engine order noise at partially-open throttle condition is illustrated. A curve "C1" represents performance of the muffler 202 at the partially-open throttle condition and a curve "C2" represents performance of the conventional muffler at the partially-open throttle condition.

As shown, the half engine order noise reduces by approximately 15-25 decibels (dBA) between approximately 1500 rotations per minute (RPM) and 3300 RPM while employing the muffler 202 in comparison to the conventional muffler. Referring to FIG. 3B, a graphical representation of engine speed against one and a half (1.5) engine order noise at wide-open throttle condition is illustrated. A curve "C3" represents performance of the muffler 202 at the wide-open throttle condition and a curve "C4" represents performance of the conventional muffler at the wide-open throttle condition. As shown, the half engine order noise reduces by approximately 10-15 dBA between approximately 1500 RPM and 3300 RPM while employing the muffler 202 in comparison to the conventional muffler. Similarly, the muffler 202 may reduce different harmonics (e.g., 3, 4.5, 6 etc.) of the half engine order noise as compared to the conventional muffler.

Referring to FIGS. 4A, 4B, 4C, and 4D, different perspective views of another embodiment of a muffler 402 are illustrated. The muffler 402 will now be explained with combined reference to FIGS. 4A to 4D. The muffler 402 has a configuration substantially similar to the configuration of the muffler 202 described with reference to FIGS. 2A to 2E. As such, the muffler 402 includes a housing 404, an outer shell 405, a first end plate 410, a second end plate 412, a first internal plate 414, a second internal plate 416, and a third internal plate 418. The muffler 402 also includes a common chamber 420, a first chamber 422, a second chamber 424, and a third chamber 426. The muffler 402 further includes a first tube 428, a second tube 434, a third tube 444, and a reinforcing rod 470. However, the muffler 402 includes a single outlet tube 454.

In the illustrated embodiment, the outlet tube 454 is disposed in each of the common chamber 420, the second chamber 424, and the third chamber 426 extending between the second internal plate 416, the third internal plate 418, and the second end plate 412. It should be noted that an arrangement, a location, and/or an orientation of the housing 404, the outer shell 405, the first end plate 410, the second end plate 412, the first internal plate 414, the second internal plate 416, the third internal plate 418, the common chamber 420, the first chamber 422, the second chamber 424, the third chamber 426, the first tube 428, the second tube 434, the third tube 444, and the reinforcing rod 470 of the muffler 402 are substantially similar to those of the muffler 202 described with reference to FIGS. 2A to 2E.

During operation, the first tube 428 is coupled to the first pipe 114 and the second tube 434 is coupled to the second pipe 116. Accordingly, the first exhaust stream "E1" is received in the common chamber 420 of the muffler 402 from the first pipe 114 via the first tube 428, as shown by an arrow 472. Also, the second exhaust stream "E2" is received in the second tube 434 from the second pipe 116. The second exhaust stream "E2" is deflected by the closed end 450 of the third tube 444 in the reversal portion 451, as shown by an arrow 474. The second exhaust stream "E2" then flows along the gap 448 between each of the second tube 434 and the third tube 444, as shown by the arrow 474, and is received in the common chamber 420 from the third tube 444, as shown by an arrow 478.

As the second exhaust stream "E2" flows through the muffler 402, the second exhaust stream "E2" travels the distance approximately equal to the difference between the first pipe length "LP1" of the first pipe 114 and the second pipe length "LP2" of the second pipe 116. More specifically, the difference between the first pipe length "LP1" of the first pipe 114 and the second pipe length "LP2" of the second pipe 116 may be approximately equal to the sum of the second length "L2" of the second tube 434 and the third length "L3" of the third tube 444 less the first length "L1" of the first tube 428, i.e., (LP1−LP2) may be approximately equal to [(L2+L3)−L1]. As such, each of the second length "L2" of the second tube 434 and the third length "L3" of the third tube 444 compensates for the difference between the first pipe length "LP1" of the first pipe 114 and the second pipe length "LP2" of the second pipe 116, in turn, limiting the half engine order noise downstream of the muffler 402. The first exhaust stream "E1" and the second exhaust stream "E2" mix with each other in the common chamber 420 and forms a mixed exhaust stream "EM". The outlet tube 454 is provided in fluid communication with the first tube 428 and the third tube 444 via the common chamber 420. Accordingly, the mixed exhaust stream "EM" then flows into the outlet tube 454, and is further discharged out of the muffler 402, as shown by an arrow 480.

In the illustrated embodiment, the outlet tube 454 includes a perforated region 466 disposed in the third chamber 426. The perforated region 466 allows a portion of the mixed exhaust stream "EM" to flow into the third chamber 426, in turn, limiting a pressure differential between the outlet tube 454 and the third chamber 426 and/or improving tuning of the muffler 402. The muffler 402 also includes a first tuning tube 482 and a second tuning tube 486. The first tuning tube 482 is disposed in the first internal plate 414 and in fluid communication with each of the common chamber 420 and the first chamber 422. The second tuning tube 486 is disposed in the second internal plate 416 and in fluid communication with each of the common chamber 420 and the second chamber 424. Each of the first tuning tube 482 and the second tuning tube 486 is adapted to allow flow of the mixed exhaust stream "EM" therethrough, as shown by arrows 484, 488, respectively. Each of the first tuning tube 482 and the second tuning tube 486 is adapted to limit a pressure differential between each of the first chamber 422, the common chamber 420, and the second chamber 424, in turn, improving tuning of the muffler 402.

It should be noted that although each of the second tubes 234, 434, 634 and the third tubes 244, 444, 644 described with reference to FIGS. 2A to 2E, FIGS. 4A to 4D, and FIG. 6, respectively, has a substantially straight configuration, in other embodiments, one or more of the second tubes 234, 434, 634 and/or the third tubes 244, 444, 644 may have any other configuration. Referring to FIGS. 7A to 7D, different exemplary configurations of a second tube and a third tube are illustrated. For example, referring to FIG. 7A, a second tube 734*a* has a substantially L-shaped or a single bent configuration and includes a second inlet 736*a* and a second outlet 738*a*. Also, a third tube 744*a* has a substantially straight configuration and includes a third outlet 746*a*. In another embodiment, referring to FIG. 7B, the second tube 734*a* has the substantially L-shaped or the single bent configuration and includes the second inlet 736*a* and the second outlet 738*a*. Also, a third tube 744*b* has a substantially L-shaped or a single bent configuration and includes a third outlet 746*b*.

Figure 7B:
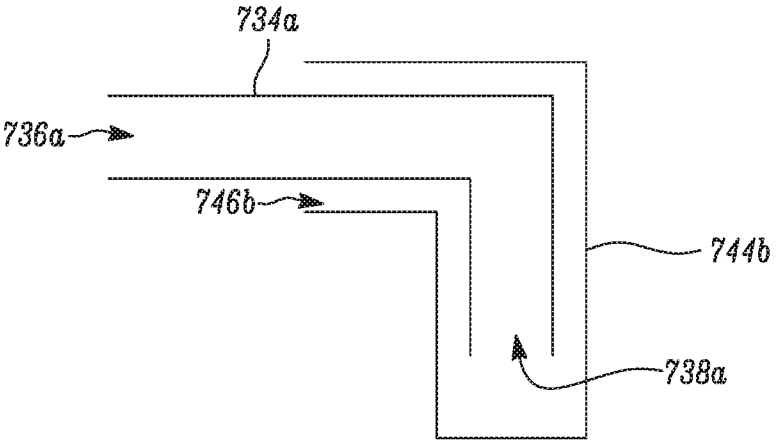
FIGS. 7A to 7D are schematic representations of different exemplary arrangements of a second tube and a third tube of another muffler, according to an aspect of the present disclosure.
Figure 7A:
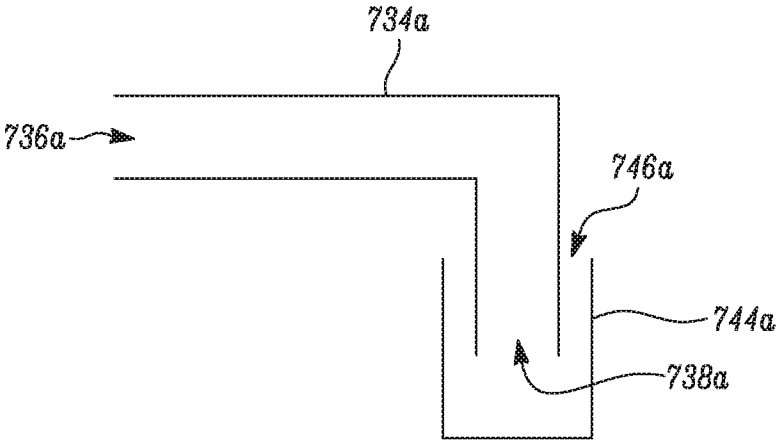
Figure 7D:
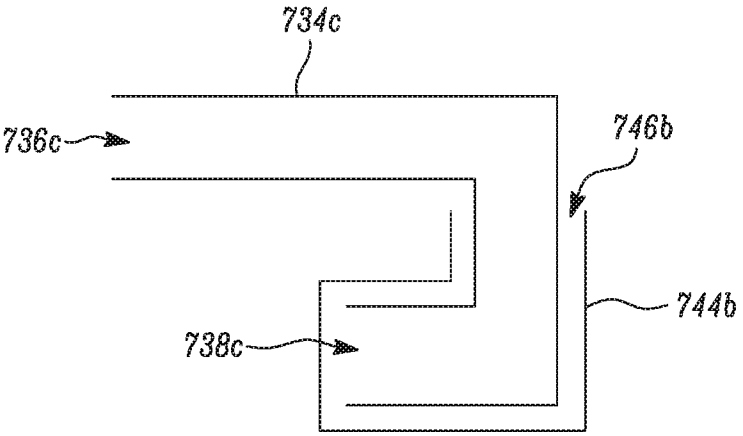
Figure 7C:
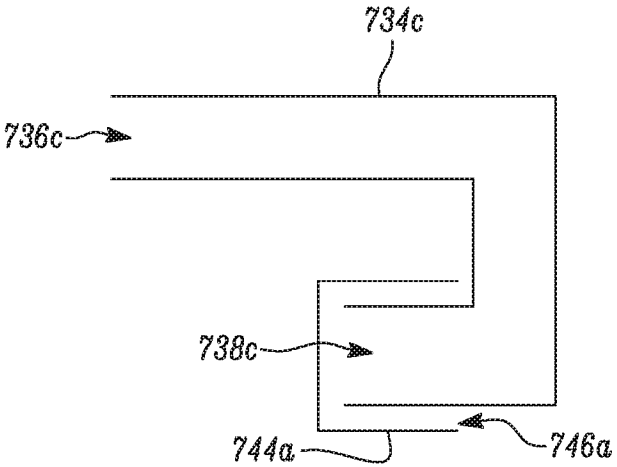

In another embodiment, referring to FIG. 7C, a second tube 734*c* has a substantially C-shaped or a double bent configuration and includes a second inlet 736*c* and a second outlet 738*c*. Also, the third tube 744*a* has the substantially straight configuration and includes the third outlet 746*a*. In yet another embodiment, referring to FIG. 7D, the second tube 734*c* has the substantially C-shaped or the double bent configuration and includes the second inlet 736*c* and the second outlet 738*c*. Also, the third tube 744*b* has the substantially L-shaped or the single bent configuration and includes the third outlet 746*b*. It should be noted that different configurations of each of the second tubes 734*a*, 734*c* and each of the third tubes 744*a*, 744*b* described herein are merely exemplary and may vary based on application requirements. As such, one or more of the second tubes 734*a*, 734*c* and/or the third tubes 744*a*, 744*b* may have single or multiple bent configurations, curved or curvilinear configurations, and so on, based on application requirements.

Figure 5:
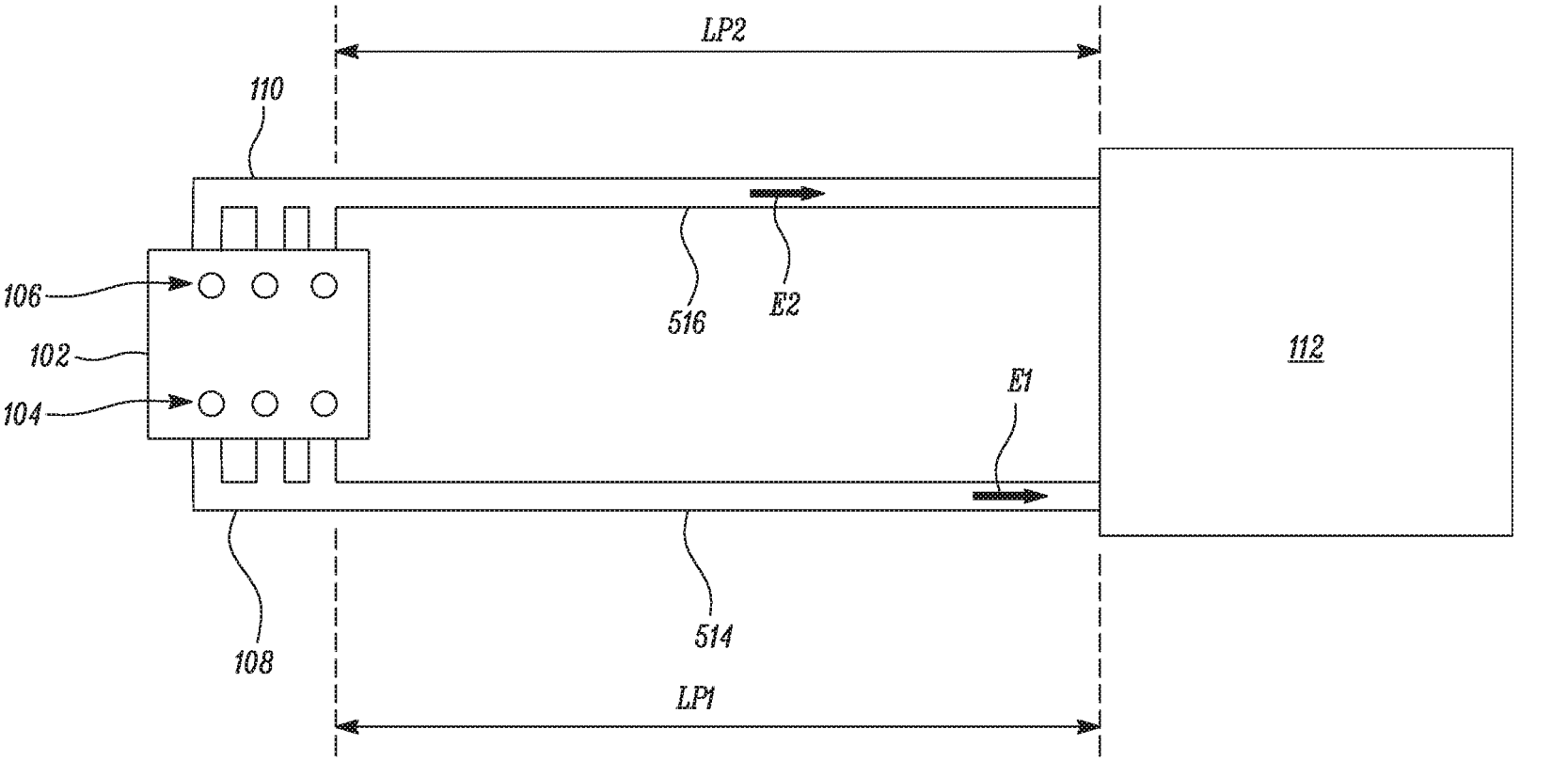
FIG. 5 is a schematic representation of another exhaust system coupled to the engine, according to an aspect of the present disclosure.

Referring to FIG. 5, an exemplary schematic representation of another exhaust system 500 coupled to the engine 102 is illustrated. In the illustrated embodiment, the first pipe length "LP1" of the first pipe 514 is approximately equal to the second pipe length "LP2" of the second pipe 516. Further, each of the first pipe 514 and the second pipe 516 is coupled to the muffler 112. The muffler 112 may be any one of the muffler 202, as described with reference to FIGS. 2A to 2E, or the muffler 402, as described with reference to FIGS. 4A to 4D, or the muffler 602, as described with reference to FIG. 6. In such a situation, each of the second length "L2" of the second tube 234, 434, 634 and the third length "L3" of the third tube 244, 444, 644 provides an increased travel distance for the second exhaust stream "E2" within the muffler 112. As such, in such a configuration, each of the second length "L2" of the second tube 234, 434, 634 and the third length "L3" of the third tube 244, 444, 644 increases the half engine order noise downstream of the muffler 112 and may be applicable in situations when the half engine order noise may be desired, such as in sports-oriented vehicles, vehicular applications requiring rumbling exhaust noise, and so on.

In other words, the sum of the second length "L2" of the second tube 234, 434, 634 and the third length "L3" of the third tube 244, 444, 644 is greater than the first length "L1" of the first tube 228, 428, i.e., (L2+L3) is greater than (L1). Accordingly, the travel length of the second exhaust stream "E2" through the second pipe 516, the second tube 234, 434, 634, and the third tube 244, 444, 644 is greater than the travel length of the first exhaust stream "E1" through the first pipe 514 and the first tube 228, 428 in order to increase the half engine order noise downstream of the muffler 202, 402, 602. In such a situation, the sum of the first pipe length "LP1" of the first pipe 514 and the first length "L1" of the first tube 228, 428 is less than the sum of the second pipe length "LP2" of the second pipe 516, the second length "L2" of the second tube 234, 434, 634 and the third length "L3" of the third tube 244, 444, 644, i.e., (LP1+L1) is less than (LP2+L2+L3) in order to increase the half engine order noise downstream of the muffler 202, 402, 602.

The muffler 202, 402, 602 provides a simple, efficient, and cost-effective method of limiting the half engine order noise within the exhaust system 100, 500. The muffler 202, 402, 602 includes the second tubes 234, 434, 634 and the third tubes 244, 444, 644 having an overlapping and concentric arrangement defining the overlap length "OL" and the reversal length "RL", in turn, providing a compact configuration, and optimizing space utilization and tuning volume within the mufflers 202, 402, 602. Also, each of the second length "L2" of the second tubes 234, 434, 634 and the third length "L3" of the third tubes 244, 444, 644 may be easily adjusted, i.e., increased or decreased, in order to tune the muffler 202, 402, 602, based on application requirements.

The arrangement also reduces an overall footprint of the muffler 202, 402, 602. The muffler 202, 402, 602 also provides improved mixing of the first exhaust stream "E1" and the second exhaust stream "E2" within the common chamber 220, 420, in turn, improving efficiency and performance of the muffler 202, 402, 602. In some situations, as described with reference to FIG. 5, the muffler 202, 402, 602 may be employed in the exhaust system 500 in order to increase the half engine order noise, based on application requirements. The muffler 202, 402, 602 may be employed in any exhaust system with little or no modification to the existing system, in turn, providing wide compatibility and usability.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A muffler for use with an engine, the muffler comprising:

a first tube defining a first inlet and a first outlet spaced apart from the first inlet, wherein the first tube receives exhaust from the engine at the first inlet;

a second tube spaced apart from the first tube, the second tube defining a second inlet and a second outlet spaced apart from the second inlet, wherein the second tube receives exhaust from the engine at the second inlet, the exhaust moving in a first direction from the second inlet to the second outlet;

a third tube disposed at least partly around the second tube, the third tube defining a third outlet spaced apart from each of the second inlet and the second outlet, wherein the third outlet is in fluid communication with the second outlet of the second tube, wherein the third tube receives exhaust gas from the second outlet and redirects the exhaust gas in a second direction opposite the first direction from the second outlet to the third outlet; and at least one outlet tube in fluid communication with the first outlet and the third outlet.

2. The muffler of claim 1, further comprising a connecting member configured to connect the second tube to the third tube.

3. The muffler of claim 1, further comprising a housing at least partly enclosing the first tube, the second tube and the third tube, the housing defining a common chamber in fluid communication with the first outlet, the third outlet and the at least one outlet tube.

4. The muffler of claim 1, wherein the third tube further comprises a closed end opposite to the third outlet, and wherein the second outlet is axially disposed between the closed end and the third outlet.

5. The muffler of claim 1, wherein a sum of a length of the second tube and a length of the third tube is greater than a length of the first tube.

6. The muffler of claim 5, wherein the length of the second tube is greater than the length of the first tube.

7. The muffler of claim 5, wherein the length of the third tube is greater than the length of the first tube.

8. The muffler of claim 1, wherein the third tube is concentrically disposed around the second tube.

9. The muffler of claim 1, wherein the second tube further comprises a closed end axially opposite to the second inlet, wherein the second outlet comprises one or more openings disposed on a wall of the second tube, and wherein the one or more openings are axially disposed between the closed end of the second tube and the third outlet of the third tube.

10. The muffler of claim 9, wherein the third tube is connected to the second tube adjacent to the closed end.

11. An exhaust system for use with an engine having a first row of cylinders and a second row of cylinders, the exhaust system comprising:

a first pipe configured to receive exhaust from the first row of cylinders;

a second pipe configured to receive exhaust from the second row of cylinders; and a muffler comprising:

a first tube defining a first inlet and a first outlet spaced apart from the first inlet, wherein the first inlet is in fluid communication with the first pipe and receives exhaust from the first row of cylinders;

a second tube spaced apart from the first tube, the second tube defining a second inlet and a second outlet spaced apart from the second inlet, wherein the second tube is in fluid communication with the second pipe and receives exhaust from the second row of cylinders, the exhaust moving in a first direction from the second inlet to the second outlet;

a third tube disposed at least partly around the second tube, the third tube defining a third outlet spaced apart from each of the second inlet and the second outlet, wherein the third outlet is in fluid communication with the second outlet of the second tube;

wherein the third tube receives exhaust gas from the second outlet and redirects the exhaust gas in a second direction opposite the first direction from the second outlet to the third outlet; and at least one outlet tube in fluid communication with the first outlet and the third outlet.

12. The exhaust system of claim 11, wherein the muffler further comprises a connecting member configured to connect the second tube to the third tube.

13. The exhaust system of claim 11, wherein the muffler further comprises a housing at least partly enclosing the first tube, the second tube and the third tube, the housing defining a common chamber in fluid communication with the first outlet, the third outlet and the at least one outlet tube.

14. The exhaust system of claim 11, wherein the third tube further comprises a closed end opposite to the third outlet, and wherein the second outlet is axially disposed between the closed end and the third outlet.

15. The exhaust system of claim 11, wherein a sum of a length of the second tube and a length of the third tube is greater than a length of the first tube.

16. The exhaust system of claim 15, wherein the length of the second tube is greater than the length of the first tube.

17. The exhaust system of claim 15, wherein the length of the third tube is greater than the length of the first tube.

18. The exhaust system of claim 11, wherein the third tube is concentrically disposed around the second tube.

19. The exhaust system of claim 11, wherein the second tube further comprises a closed end axially opposite to the second inlet, wherein the second outlet comprises one or more openings disposed on a wall of the second tube, and wherein the one or more openings are axially disposed between the closed end of the second tube and the third outlet of the third tube.

20. The exhaust system of claim 19, wherein the third tube is connected to the second tube adjacent to the closed end.

21. The exhaust system of claim 11, wherein a length of the first pipe is greater than a length of the second pipe.

22. The exhaust system of claim 21, wherein a sum of a length of the second tube and a length of the third tube is greater than a length of the first tube such that a half engine order noise downstream of the muffler is decreased.

23. The exhaust system of claim 11, wherein a length of the first pipe is substantially equal to a length of the second pipe.

24. The exhaust system of claim 23, wherein a sum of a length of the second tube and a length of the third tube is greater than a length of the first tube such that a half engine order noise downstream of the muffler is increased.

25. The exhaust system of claim 11, wherein a sum of a length of the first pipe and a length of the first tube is substantially equal to a sum of a length of the second pipe, a length of the second tube and a length of the third tube.

26. The exhaust system of claim 11, wherein a sum of a length of the first pipe and a length of the first tube is less than a sum of a length of the second pipe, a length of the second tube and a length of the third tube.

27. A muffler for use with an engine, the muffler comprising:

a first tube defining a first inlet and a first outlet spaced apart from the first inlet, wherein the first tube receives exhaust from the engine at the first inlet;

a second tube spaced apart from the first tube, the second tube defining a second inlet and a second outlet spaced apart from the second inlet, wherein the second tube receives exhaust from the engine at the second inlet, the exhaust moving in a first direction from the second inlet to the second outlet;

a third tube disposed at least partly around the second tube, the third tube defining a third outlet spaced apart from each of the second inlet and the second outlet, wherein the third outlet is in fluid communication with the second outlet of the second tube, wherein the third tube receives exhaust gas from the second outlet and redirects the exhaust gas in a second direction opposite the first direction from the second outlet to the third outlet;

a housing at least partly enclosing the first tube, the second tube and the third tube, the housing defining a common chamber in fluid communication with the first outlet and the third outlet; and at least one outlet tube in fluid communication with the common chamber.

28. The muffler of claim 27, wherein the third tube further comprises a closed end opposite to the third outlet, and wherein the second outlet is axially disposed between the closed end and the third outlet.

29. The muffler of claim 27, wherein the second tube further comprises a closed end axially opposite to the second inlet, wherein the second outlet comprises one or more openings disposed on a wall of the second tube, and wherein the one or more openings are axially disposed between the closed end of the second tube and the third outlet of the third tube.

30. The muffler of claim 29, wherein the third tube is connected to the second tube adjacent to the closed end.

31. The muffler of claim 1, wherein the third tube overlaps the second tube at the outlet end of the second tube.

* * * * *